US007018526B1

(12) United States Patent
Isayev et al.

(10) Patent No.: US 7,018,526 B1
(45) Date of Patent: Mar. 28, 2006

(54) CARBONIZED PITCH MOLDINGS PREPARED FROM SYNTHETIC MESOPHASE PITCH AND HEAT-SOAKED ISOTROPIC PITCH

(75) Inventors: Avraam I. Isayev, Akron, OH (US); Kyungwoo Choi, Akron, OH (US)

(73) Assignee: The University of Akron, Akron, OH (US)

( * ) Notice: Subject to any disclaimer, the term of this patent is extended or adjusted under 35 U.S.C. 154(b) by 368 days.

(21) Appl. No.: 09/998,938

(22) Filed: Nov. 30, 2001

(51) Int. Cl.
*C10C 3/00* (2006.01)

(52) U.S. Cl. ..... 208/43; 208/44

(58) Field of Classification Search ..... 208/43, 208/44

See application file for complete search history.

(56) References Cited

U.S. PATENT DOCUMENTS

| | | | | |
|---|---|---|---|---|
| 3,974,264 | A | 8/1976 | McHenry | 423/447.4 |
| 4,005,183 | A | 1/1977 | Singer | 423/447.2 |
| 4,209,500 | A | 6/1980 | Chwastiak | 423/447.6 |
| 4,608,150 | A | 8/1986 | Itoi et al. | 208/22 |
| 4,789,455 | A | 12/1988 | Mochida et al. | 208/39 |
| 4,913,889 | A | 4/1990 | Takai et al. | 423/447.1 |
| 4,929,404 | A | 5/1990 | Takahashi et al. | 264/29.5 |
| 4,986,943 | A | 1/1991 | Sheaffer et al. | 264/29.1 |
| 5,156,831 | A | 10/1992 | Fain et al. | 423/447.1 |
| 5,182,010 | A | 1/1993 | Mochida et al. | 208/44 |
| 5,225,070 | A | 7/1993 | Cornec et al. | 208/44 |
| 5,266,294 | A | 11/1993 | Schulz et al. | 423/447.1 |
| 5,372,702 | A | 12/1994 | Kojima et al. | 208/39 |
| 5,413,738 | A | 5/1995 | Lewis et al. | 252/502 |
| 5,494,567 | A * | 2/1996 | Tamaki | 208/44 |
| 5,501,788 | A * | 3/1996 | Romine et al. | 208/45 |
| 5,688,155 | A | 11/1997 | Lewis et al. | 442/179 |

OTHER PUBLICATIONS

Marsh et al., 'The Structure and Behavior of QI Material in Pitch' in CARBON vol. 23 No. 5 pp. 555-570 (1985).*

Y. Korai, et al., *Preparation of Mesocarbon Microbeads By Dispersing Mesophase Pitch In Isotropic Pitches Carbon* vol. 35, No. 10-11, pp. 1503-1515, 1997.

* cited by examiner

*Primary Examiner*—Stuart Hendrickson
(74) *Attorney, Agent, or Firm*—Roetzel & Andress; George W. Moxon, II

(57) ABSTRACT

The present invention provides carbonized pitch articles and methods for producing the same. Synthetic mesophase pitch is mixed with partially anisotropic pitch, which may be selected from heat-soaked isotropic pitch and heat-soaked mixtures of isotropic pitch and mesophase pitch. In producing carbon moldings, the mesophase pitch is first stabilized to make it at least partially infusible, prior to mixing. In producing carbon fibers, the mesophase pitch will not typically be stabilized before mixing, rather, the resultant pitch fiber, produced from the mixture, will be stabilized by oxidation and air. The resultant fibers and moldings are carbonized according to conventional methods.

4 Claims, 3 Drawing Sheets

(a) ARA24 carbon fiber at 1800°C for 15 min.

(b) ARA24 carbon fiber at 1800°C for 60 min.

(c) Pitch blend (ARA24/A240 400°C 25 hrs, 50/50) at 1800°C for 15 min (d) Pitch blend (ARA24/A240 400°C 25 hrs (50/50) at 1800°C for 60 min

CARBONIZED PITCH MOLDINGS PREPARED FROM SYNTHETIC MESOPHASE PITCH AND HEAT-SOAKED ISOTROPIC PITCH

TECHNICAL FIELD

The present invention generally relates to carbonized pitch articles, such as pitch moldings and pitch fibers, and, more particularly, to carbonized pitch articles prepared from hydrocarbon-derived synthetic mesophase pitch, as filler, and partially anisotropic pitch, as binder. This invention also provides partially anisotropic pitch prepared by heat-soaking a mixture of petroleum-derived isotropic pitch and synthetic mesophase pitch.

BACKGROUND OF THE INVENTION

The most common carbonized pitch articles include pitch moldings and pitch fibers. Carbonized pitch moldings are generally known, and typically consist of a carbon filler material and a carbon "matrix" or "binder" material. The carbon filler material is generally carbon or graphite fibers, carbon or graphite particles, or a combination thereof, while the carbon binder material can be provided by a pitch, an organic resin, the thermopyrolysis of a carbon-bearing vapor, or combinations thereof. During carbonization of a mixture of such filler and binder materials, the binder material becomes interbonded with the carbon filler material. The binder material interbonds with the carbon filler material.

A general method for producing carbon pitch moldings, in other words particulate carbon composite moldings, includes the mixing of carbon filler material and carbon binder material, with the subsequent heat treatment of this mixture in an inert atmosphere, at elevated temperatures of at least about 500° C., to decompose the binder material. This heat treatment, commonly referred to as "carbonization," leaves behind a carbonaceous residue that is bonded to the carbon filler material.

Carbon pitch fibers are also generally known and are typically comprised of mesophase pitches. Pitch-based carbon fibers are generally produced by first either obtaining mesophase pitch commercially or producing mesophase pitch through heat-soaking of an isotropic pitch. Then, this mesophase material is melt-spun, or otherwise processed to form pitch fibers. The pitch fibers are oxidized in air to form an infusible structure, and thereafter carbonized, under inert atmosphere and high temperatures, to produce a carbon fiber, or they may be graphitized at even higher temperatures to produce a graphite fiber. Such fibers are used in many applications, and can also undergo surface treatment to affect adhesion in a resin matrix for carbon molding applications.

The strength and other mechanical properties of carbonized pitch moldings suffer from the fact that pitch moldings tend to have a relatively high degree of porosity. This porosity results during carbonization of the mixture of the carbon filler material and carbon binder material due to bloating of the pitch molding from the volatilization of low molecular weight components and the removal of gaseous heteroatoms, such as oxygen and nitrogen, within the binding and filler materials. For pitch filler and binder materials without stabilization, up to about 60% by weight of the pitch may be lost during carbonization under inert environment, as a result of volatilization and gasification. This loss of material results in the creation of voids within the carbonized pitch molding, producing a composite having high porosity, low density, and reduced strength.

Carbonized pitch moldings also suffer from a lack of homogeneous stabilization throughout the molding, especially in those moldings having larger, on the order of at least 70 μm, thickness. Typically, during carbonization of thick pitch moldings, the bloating phenomenon is observed, leading to discarded moldings. Others have attempted to stabilize bulk pitch articles, but, due to the limited depth of oxygen diffusion in such articles, these attempts have not been very successful at achieving full stabilization without the creation of micropores. If one prepares a pitch molding first and subsequently tries to stabilize it in oxygen rich environment, full stabilization throughout the body is impossible.

During stabilization of pitch fibers, low molecular weight volatile components within the pitch are evaporated and, therefore, a skin/core microstructure tends to be produced upon carbonization. Upon carbonization, the outer portions of pitch fiber generally exhibit an onion-skin structure characterized by fine sheets of crystallites, while the core portion tends to exhibit a more random structure. Such a microstructure does not promote good mechanical properties.

Although the prior art has attempted to deal with these problems, as evidenced by the patents and literature referenced herein, the present invention provides carbonized pitch articles and methods for producing the same heretofore unknown in the art. Particularly, this invention teaches mixing synthetic mesophase pitch powder with partially anisotropic pitch prepared, at least in part, from petroleum-derived isotropic pitch, forming an article from the mixture, and, subsequently carbonizing the article in an inert environment. Particularly, such articles include pitch fibers and pitch moldings. The present invention also teaches an improved preparation of partially anisotropic pitch, wherein a mixture of synthetic mesophase pitch and petroleum-derived isotropic pitch is thermally polymerized by heat-soaking.

SUMMARY OF THE INVENTION

The present invention provides a process for preparing pitch with optically anisotropic content, including the steps of mixing synthetic mesophase pitch and petroleum-derived isotropic pitch, and thermally polymerizing the resultant mixture by heat-soaking. Notably, the presence of the synthetic mesophase pitch, during heat-soaking, causes an unexpected synergistic effect on mesophase formation. Particularly, such mixtures unexpectedly show increased rates of mesophase formation as compared to the heat-soaking of petroleum-derived isotropic pitch alone.

The present invention also provides a process for preparing carbonized pitch moldings, including the steps of powdering synthetic mesophase pitch; powdering partially anisotropic pitch selected from a heat-soaked petroleum-derived isotropic pitch and a heat-soaked mixture of petroleum-derived isotropic pitch and synthetic mesophase pitch; stabilizing the powdered synthetic mesophase pitch to create at least partially stabilized powdered synthetic mesophase pitch; and mixing the at least partially stabilized powdered synthetic mesophase pitch, as filler, with the powdered partially anisotropic pitch, as binder.

The present invention further provides a process for preparing carbonized pitch fibers including the steps of mixing partially anisotropic pitch with synthetic mesophase pitch, wherein the partially anisotropic pitch is selected from a heat-soaked petroleum-derived isotropic pitch and a heat-soaked mixture of petroleum derived isotropic pitch and synthetic mesophase pitch; spinning the mixture into pitch fibers; and stabilizing the resultant pitch fibers. These stabilized pitch fibers may then be carbonized at temperatures up to about 1800° C., in an inert environment.

In more particular embodiments for preparing pitch moldings, the mixture created in the mixing step preferably contains from about 60 to about 70% by weight of the synthetic mesophase pitch and from about 30 to about 40% by weight of the partially anisotropic pitch. For preparing pitch fibers, the mixture preferably contains from about 60 to about 40% by weigh of the synthetic mesophase pitch and from about 40 to about 60% by weight of the partially anisotropic pitch. For pitch moldings, however, the synthetic mesophase pitch is at least partially stabilized prior to mixing. For pitch fibers, the synthetic mesophase pitch will typically not be stabilized prior to mixing, inasmuch as stabilization may introduce infusible particles that will frustrate the ability to spin fibers.

Notably, the synthetic mesophase pitch is stabilized prior to the production of pitch moldings, and therefore exhibits little or no bloating during carbonization, because, during the stabilization process, its high content of volatiles is substantially reduced, and molecules in the pitch are stabilized by forming "locked-in" structures. In other pitch molding embodiments, the partially anisotropic pitch, which serves as a binder for the synthetic mesophase pitch filler, is selected or caused to have a low content of volatiles, and, thus, the volatile content therein may be reduced, if desired, through a slight degree of stabilization of the partially anisotropic pitch that is low enough to sustain its fusibility at the requisite molding temperature for the mixture.

The pitch fibers created from mixtures of synthetic mesophase pitch and petroleum-derived isotropic pitch exhibit desirable radial-folded texture in cross-section, which is expected to lead to better mechanical properties over those fibers exhibiting random transverse morphology, as it typically encountered in the prior art.

PREFERRED EMBODIMENT FOR CARRYING OUT THE INVENTION

Figure 1:
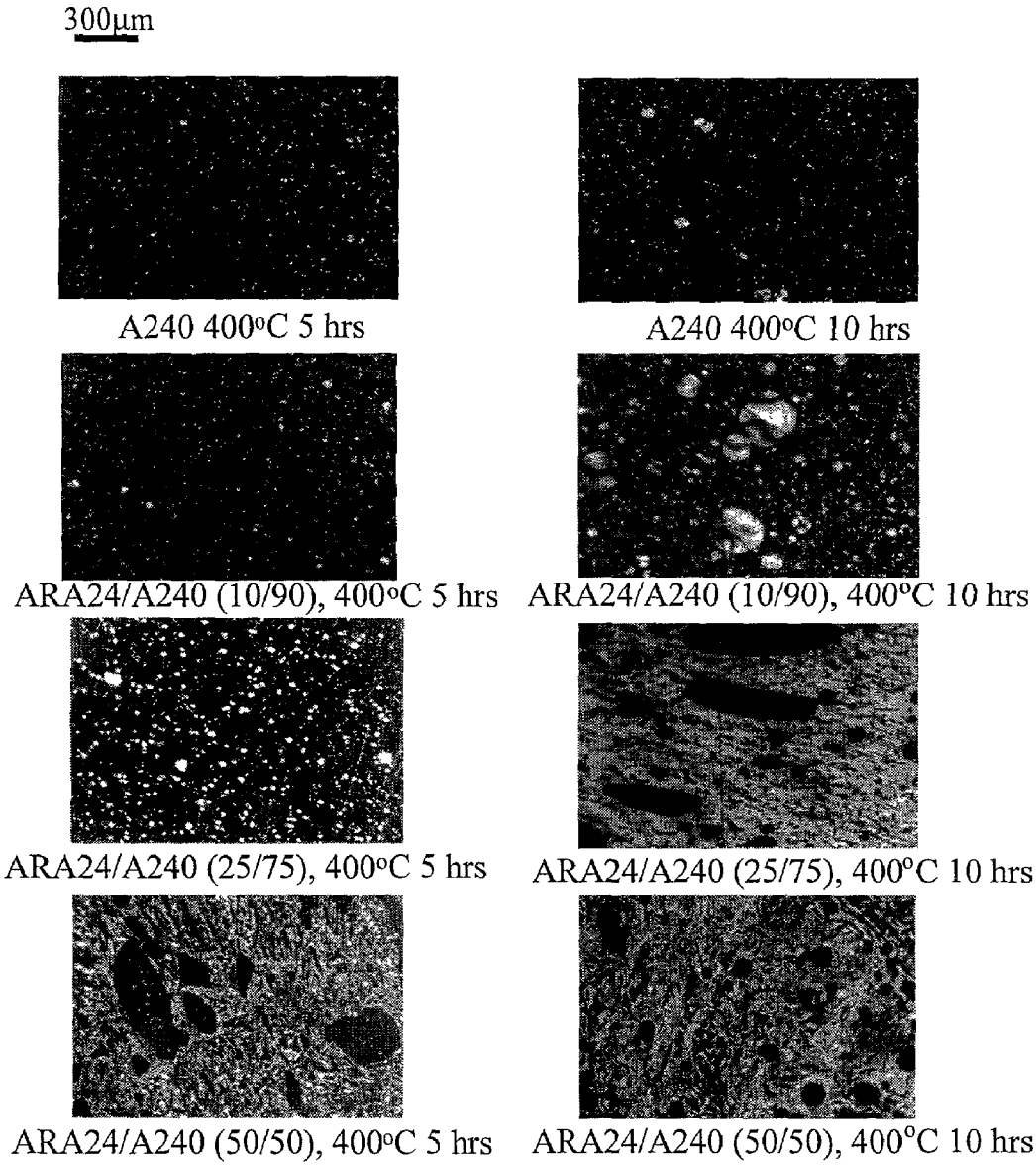
FIG. 1 shows photomicrographs of heat-soaked blends of petroleum-derived isotropic pitch and synthetic mesophase pitch.

The present invention provides improved pitch moldings and pitch fibers and an improved processes for forming the same.

In the pitch molding process, synthetic mesophase pitch is powdered and stabilized through oxidation to provide an at least partially infusible, powdered synthetic mesophase pitch. This at least partially infusible, powdered synthetic mesophase pitch is mixed with a powdered partially anisotropic pitch, and, thereafter, the resultant mixture is formed into pitch moldings through known methods. The partially anisotropic pitch serves as a binder for the at least partially infusible synthetic mesophase pitch filler. The pitch article is then carbonized through known methods.

In the pitch fiber process, synthetic mesophase pitch is mixed with partially anisotropic pitch, and the mixture is spun into fibers. The as-spun fibers are then stabilized through oxidation, and, thereafter, can be carbonized through common methods to produce carbon fibers.

The partially anisotropic pitch in either process may be provided by thermally polymerizing (or "heat-soaking") either petroleum-derived isotropic pitch or a mixture of synthetic mesophase pitch and petroleum-derived isotropic pitch. It has been unexpectedly found that thermally polymerizing a mixture of synthetic mesophase pitch and petroleum-derived isotropic pitch causes a faster rate of formation of the anisotropic, or "mesophase", portion. Thus, in addition to providing improved pitch articles and a processes for making the same, the present invention provides an improved process for providing pitch with optically anisotropic content, and the partially anisotropic pitch resulting from this process may be employed to practice the pitch molding and pitch fiber preparation methods.

In the present invention, partially anisotropic pitch serves as either a binder for infusible synthetic mesophase pitch filler to provide improved pitch moldings or as a component of a blend of synthetic mesophase pitch and partially anisotropic pitch to provide improved pitch fibers. The partially anisotropic pitch binder is prepared by thermally polymerizing, through heat-soaking processes, either a petroleum-derived isotropic pitch or a mixture of synthetic mesophase pitch and petroleum-derived isotropic pitch.

Generally, isotropic pitch is transformed into partially anisotropic pitch by thermally polymerizing isotropic pitch through a conventional "heat-soaking" method. Heat-soaking of isotropic pitch causes mesophase formation, thereby producing a partially anisotropic pitch. Various heat-soaking methods are known, and it is possible to convert isotropic pitch into 100% mesophase pitch, such that the term "partially anisotropic pitch," as used herein, is to be understood to cover heat-soaked isotropic pitch that has only been partially converted to mesophase, as well as heat-soaked isotropic pitch that has completely converted to mesophase.

In typical heat-soaking processes, isotropic pitch is heated in a reactor at a temperature of about 350° C. to about 450° C., in an inert atmosphere. The low molecular weight components of the raw isotropic pitch volatized during the heat treatment, and at least a portion of the optically isotropic pitch is converted to high molecular weight, optically anisotropic mesophase pitch. The optically anisotropic or "mesophase" portion of the pitch, having a higher gravity, can be precipitated and collected from the bottom of the reactor. This general process can be improved by agitating the system during the heat treatment, thereby forming a homogenous emulsion of the isotropic and mesophase components. The process has also been improved upon by introducing an inert gas spurge into the molten pitch reactor.

While virtually any heat-soaking method, as known in the art, could be employed to produce the partially anisotropic pitch for use in this invention, the preferred heat-soaking method involves heat-soaking under agitation to form an homogenous emulsion. Heat-soaking temperature and time are the most important parameters controlling the rate of mesophase formation and the content of mesophase. Also, the heating rate, speed of agitation, and removal of low molecular weight volatiles by venting may, to some extent, affect mesophase formation.

It has already been mentioned that heat-soaking temperatures typically range from about 350° C. to about 450° C. Heat-soaking will generally be carried out for a duration of from about 2 to about 25 hours, with the understanding that shorter heat-soaking times will result in a less optically anisotropic sample as compared to a sample treated at the same temperature and for a longer duration. The heat-soaking temperature is reached by heating the pitch at a particular heating rate, which preferably ranges from about 2.5 to about 15° C./min. Agitating the pitch during heat-soaking, may also affect mesophase formation, with substantial agitation having the effect of promoting homogenization of the optically anisotropic and isotropic portions and aiding in removing volatiles. Finally, heat-soaking is typically carried out in a vented environment, in order to remove low molecular weight volatiles, and this venting may effect mesophase formation and content because insufficient removal of volatiles may lead to the formation of micropores in an article subjected to carbonization.

Heat-soaking methods can be used to prepare partially anisotropic pitch from petroleum-derived isotropic pitch, alone, or from mixtures of petroleum-derived isotropic pitch and synthetic mesophase pitch. When a mixture of isotropic and mesophase pitch is employed, an increased rate of mesophase formation is unexpectedly realized. It is believed that the presence of the synthetic mesophase domains within the pitch blends act as nuclei for growth and subsequent coalescence of the isotropic phase to become optically anisotropic. The presence of the mesophase domain leads to synergistic effects in the mesophase formation within blends of synthetic mesophase pitch and petroleum-derived isotropic pitch after a relatively short duration of heat-soaking.

The pitch blends will preferably contain from about 10 to about 70% by weight synthetic mesophase pitch and from about 90 to about 30% by weight petroleum-derived isotropic pitch. The initial mesophase content within the pitch blend and the duration for which the mixture is heat-soaked can affect the optically anisotropic textures of the resultant heat-soaked sample. It is believed that the mesophase domains within the heat-soaked mixtures are formed by the nucleation and growth of the isotropic pitch, as well as by the growth of the mesophase domains resulting from the synthetic mesophase pitch initially present in the mixture. Mixtures with higher initial mesophase content will exhibit more optically anisotropic domains as compared to heat-soaked mixtures having less initial mesophase content. Mixtures heat-soaked for longer duration will exhibit optically anisotropic domains of larger size as compared to mixtures treated for a lesser duration. Thus, more and/or larger optically anisotropic flow textures can be obtained either by adding more (i.e. nearer 70 wt %) synthetic mesophase pitch into the mix, by heat-soaking the mixture for a longer duration, or through a combination of these two variables. By way of further example, mixtures with more initial mesophase content, but with less heat-soaking duration, exhibit more optically anisotropic domains, but of smaller size. Mixtures with less initial mesophase content, but heat-soaked for longer duration, exhibit less optically anisotropic domains, but of larger size. Understanding these general trends, one can experiment with mesophase content and heat-soaking duration to produce a desired effect in a resultant heat-soaked sample.

The isotropic pitch and mesophase pitch components are pelletized, crushed, or powdered, and then introduced into the reactor for heat-soaking. The heat-soaking process follows conventionally known methods, as disclosed above.

Heat-soaking the mixture of synthetic mesophase pitch and petroleum-derived isotropic pitch is preferably performed at a temperature of 400° C. to about 450° C., for relatively short durations of about 5 to about 10 hours. To measure optical anisotropy, the solid surface of heat-soaked pitch blends may be polished and observed by using a typical reflected, cross-polarized, optical microscope. The optical anisotropy of such heat-soaked pitch blends, measured by using image-analyzing software, unexpectedly shows significantly higher rates of mesophase formation as compared to that of heat-soaking of petroleum-derived isotropic pitch alone. As heat-soaking time increases the amount of synthetic mesophase pitch employed in the mixture may be decreased.

In preparing carbonized pitch moldings according to the present invention, a partially anisotropic pitch, as disclosed above, is employed as a binder for a synthetic mesophase pitch filler, and the mixture of this binder and filler is formed into moldings that are subsequently carbonized by heat treatment in an inert atmosphere. Before mixing, the synthetic mesophase pitch is first powdered and then stabilized to produce an at least partially infusible synthetic mesophase pitch powder. This prestabilization of the mesophase filler reduces the presence of volatile components and forms stabilized "locked-in" molecular structure within the formed pitch moldings, and, upon carbonization, there is minimal bloating, such that the carbonized pitch moldings have low porosity and good dimensional stability, strength, and microstructure.

Synthetic mesophase pitches and petroleum-derived isotropic pitches for use in this invention are commercially available and, thus, they may be either directly purchased or provided through known methods. Once obtained, the petroleum-derived isotropic pitch is converted to partially anisotropic pitch by heat-soaking either alone or in a pitch blend with synthetic mesophase pitch, as disclosed above. Thereafter, the synthetic mesophase pitch and the partially anisotropic pitch are ground into fine powders.

The synthetic mesophase pitch and partially anisotropic pitch are ground into powders for a number of reasons. First, by grinding these pitch components into powders, a good mix is ensured during the mixing of the synthetic mesophase and partially anisotropic pitch to create pitch moldings. Additionally, the synthetic mesophase pitch powder, and optionally, the partially anisotropic pitch powder can be either stabilized or oxygenated without full stabilization, through heat-treatment, in order to reduce the volatile component content within those pitch components before the formation of pitch moldings and the carbonization thereof. More particularly, by grinding the pitch components to powders of small dimensions, oxygen is more likely to reach throughout and stabilize the entire mass of the pitch, thus, significantly reducing, if not fully eliminating, the volatile content of the pitch component. By reducing the amount of volatiles and forming a stabilized molecular structure before molding formation and carbonization, bloating of the synthetic mesophase pitch during carbonization is significantly reduced, and the carbonized pitch article produced exhibits lower porosity, good dimensional stability and strength, and higher density as compared to pitch moldings produced from non-stabilized pitch components. Since the pitch material is oxidized in the form of a fine powder, one can expect uniform oxygen distribution in the powder and, subsequently, a full stabilization throughout the body of the pitch moldings. This is believed to be the result of the fact that there is less need for oxygen to reach the core of the pitch molding during carbonization, because the synthetic mesophase filler within the core has already been fully stabilized by heat-treatment.

The partially anisotropic pitch may also be oxygenated or partially stabilized prior to mixing with the synthetic mesophase pitch. It may be desirable to oxygenate or partially stabilize the partially anisotropic pitch, without full stabilization, in order to ensure that the pitch binder has a low content of volatiles. However, care must be taken that such oxygenation or partial stabilization of the partially anisotropic pitch binder does not cause it to become too infusible for processing at the requisite temperature. Therefore, the heating temperature for this partial stabilization should be set below typical stabilization temperatures at which the cross-linking of molecules by oxygen-containing links is expected.

The pitch components, both synthetic mesophase pitch and partially anisotropic pitch, are ground into powders of micrometer scale. Preferably, the powders are less than about 100 μm in at least one dimension, although some larger, coagulated pitch powder particles may exist. The presence of a small amount of such larger particles should not deleteriously affect subsequent mixing, article formation, and carbonization.

Grinding of the pitch powders may be done manually, as with a pestle and mortar or, simply, with two flat grinding surfaces. The pitch powders may tend to adhere to the grinding surfaces and form thin pitch layers, so it is preferable that the grinding operation be performed at a low temperature to keep the pitch brittle for manual grinding. Although manual powdering is sufficient for small quantities of pitch, the pitch components, especially in larger quantities, may be powdered using an automatic milling system consisting of a rotating mill placed in static metallic screen. This kind of machine can produce fine powders without allowing pitch to adhere on the screen. The size distribution of powders can be controlled by varying the mesh size of the screen, the rotating mill speed, and the feed rate.

The size of the pitch powders can be measured with an optical microscope. Preferably, the pitch powders have at least one dimension on the order of about 20 to 70 μm, in order to ensure that the subsequent stabilization thereof is satisfactory. It should be noted that filter screens of the required mesh may be employed to ensure that the pitch powders are of proper dimension.

Bloating of the synthetic mesophase pitch, at elevated temperatures, needs to be prevented prior to shaping of the pitch molding in order to produce the desired dimensionally stable carbonized pitch moldings. Therefore, the synthetic mesophase pitch powder is stabilized prior to mixing with the partially anisotropic pitch. Due to the limited depth of oxygen diffusion in the synthetic mesophase pitch, the pitch should be in the form of particles that are less than 70 μm in at least one dimension. The grinding process has already been disclosed.

Once ground to the proper dimensions, the synthetic mesophase pitch powder is placed in a vacuum oven, with exposure to flowing air, and oxidized at a temperature of from about 230 to 300° C., for an isothermal heating time that may range from several minutes to a few hours. The average heat rate to the final temperature should be from about 2.5 to about 5.0° C./min. Forced air flow is applied to the vacuum oven using a connected air compressor, and the air flow rate is adjusted. In order to ensure that stabilization is complete, the stabilization variables of duration, temperature, heat rate, and air flow rate are selected and adjusted to realize a weight gain of at least about 6% in the synthetic mesophase pitch powder. It will be appreciated that this stabilization step will create an at least partially infusible synthetic mesophase pitch, and such partially infusible synthetic mesophase pitch will be useful in the present invention. However, for many applications it will be preferred that these synthetic mesophase pitch be fully infusible.

As mentioned, the partially anisotropic pitch can also be oxygenated or partially stabilized before mixing with the synthetic mesophase pitch powder. The process for partial stabilization would be similar that disclosed above, however, to ensure that the partially anisotropic pitch is oxygenated to a degree that is low enough to sustain its fusibility at the requisite molding temperature for the mixture, the oxidation process should be more precisely controlled, as described in U.S. Pat. No. 5,306,415 by Cornec and Fain, incorporated herein by reference. For this controlled stabilization, one has to set a temperature at which oxygen can infuse into the pitch material without fully stabilizing the oxygen-infused pitch material, so the resulting oxygenated pitch can be formed into any desirable shape prior to being stabilized in such shape. To prepare the oxygenated pitch powder without stabilization, pitch powder is heated in an oxygen-containing environment at a set temperature that must be below the predetermined critical temperature ($T_c$). Here, $T_c$ is the temperature at which the oxygen stabilization reaction begins to occur in the oxygenated pitch. The critical temperature for pitch material can be determined by performing thermal analysis such as TGA (Thermogravimetric Analyzer) or DSC (Differential Scanning Calorimeter) in an oxidation environment. This critical temperature is typically measured as the temperature corresponding to either an abrupt weight gain in TGA analysis or to the start of exothermic reaction in DSC analysis.

The at least partially infusible synthetic mesophase pitch powder is mixed with the partially anisotropic pitch powder to form a pitch mixture. As mentioned, the partially anisotropic pitch may also be partially stabilized. The pitch mixture preferably contains from about 60 to about 70% by weight of the stabilized synthetic mesophase pitch and from about 40 to about 30% by weight of the partially anisotropic pitch. These weight percent ranges are merely preferred, and it should be appreciated that other mix ratios are possible and can be experimentally determined to be useful for a given application.

A melt blended mixture may be prepared, or the pitch powders may be mixed in solid state. Mixtures of the powders may be prepared using traditional mixing apparatus, such as rotational double cone mixers and sigma blade mixers. For melt mixing of binder, other mixing apparatus such as Brabender internal mixers and reactor mixers, as known in the art, may be used. For powder mixing on a small scale, a grinding/mixing device, called a vibrating mill may be used to obtain a homogenous mixture.

The mixed powders can then be formed into pitch moldings as commonly known in the art. Pitch-based carbon moldings can be produced with injection molding machines, compression molding machines, and through hot pressing. The mixture of solid powders or the melt mixture can be directly formed into a molded shape. However, additional crushing steps may be necessary for melt mixtures prior to the molding process. After molding formation, the molded articles can be carbonized under inert environment without further stabilization. The mechanical and electrical properties of carbonized pitch moldings are usually improved with higher molding pressure. The dimensional stability of pitch moldings, after carbonization, is improved when molded at higher pressures.

In preparing carbonized pitch fibers according to this invention, a partially anisotropic pitch, as disclosed above, is employed as one component of a pitch blend of synthetic mesophase pitch and partially anisotropic pitch, and this pitch blend is formed into pitch fibers that are subsequently stabilized and, thereafter, carbonized. Notably, the synthetic mesophase pitch is not stabilized prior to mixing with the partially anisotropic pitch inasmuch as stabilized synthetic mesophase pitch, with its high degree of infusible particles, cannot readily be spun into fibers. Rather, the stabilization step occurs after the creation of the fibers, with carbonization following thereafter.

The pitch blend preferably contains from about 20 to about 60% by weight of the synthetic mesophase pitch, more preferably from about 40 to about 60% by weight, and from about 80 to about 40% of the partially anisotropic pitch, more preferably from about 50 to about 40% by weight. These ranges are merely preferred, and it should be appreciated that other mix ratios are possible and can be experimentally determined to be useful for a given application. The pitch blends are created through melt-mixing, without heat-soaking, at temperatures of from about 290 to about 375° C., more preferably at temperatures of from about 320 to about 380° C., with the understanding that the melt-mix temperature will vary depending upon the softening point temperatures of the partially anisotropic pitch, which is, in turn, dependant upon the degree of heat-soaking.

After the creation of the pitch blend, pitch-based carbon fibers can be spun by a variety of conventional methods, such as centrifugal spinning, jet spinning, and melt spinning. After fiber formation, the fibers are stabilized by oxidation in air and, subsequently, carbonized to become literally "carbon fibers."

The as-spun fibers are preferably fully stabilized at a temperature of from about 230 to about 300° C., more preferably from about 270 to about 300° C. with a heating rate of from about 1 to about 10° C./min, more preferably 2 to about 5° C./min. Stabilization is preferably carried out until a target weight gain of at least about 6% is realized. After stabilization, the pitch fibers are carbonized.

The pitch moldings and pitch fibers, as above, may be carbonized as commonly known in the art. While it is sometimes conventional to oxidize pitch moldings before beginning the carbonization process, as in the case of the stabilization of the pitch matrix of a carbon fiber reinforced carbon composite, such an oxidation process should not be necessary in the present invention, due to the fact that the synthetic mesophase pitch filler is stabilized prior to mixing with the partially anisotropic pitch binder. Of course, as mentioned above, pitch fibers of this invention are oxidized (stabilized) prior to carbonization.

During carbonization, the pitch moldings are heated in an inert atmosphere to temperatures of from about 500° C. up to about 2300° C. in order to drive off non-carbon elements from the stabilized filler material (synthetic mesophase pitch) and to carbonize the binder (partially anisotropic pitch) and filler materials to leave behind a carbonaceous residue bonded to the carbonaceous filler material. Typically, the carbonization reaction proceeds in two stages. During the first stage, the pitch molding is brought to and held at below 800° C., allowing the majority of the weight loss due to evaporation of volatile components to occur. This process step is commonly referred to as "precarbonization." For the present invention, the precarbonization step is preferably carried out slowly, on the order of from about 2 to about 3 hours, to avoid damaging the pitch molding by forming pores and microcracks therein. Therefore, the moldings are heated slowly up to 800° C. temperature, and are maintained at that temperature for at least one hour, to minimize damaging flaws in the molding.

After precarbonization, the moldings can be rapidly carbonized above 1700° C. to obtain high strength, high modulus articles. Notably, "graphitization" may also be carried out. Graphitization, which can be considered a more narrowly-defined type of carbonization, typically involves heat treatment at temperatures above about 2300° C., while heat treatment at temperatures up to about 2300° C. is usually termed "carbonization". Pitch moldings of this invention may be subjected to carbonization or graphitization reactions, depending upon the intended end use and desired properties of the pitch moldings.

This invention provides advances in the art of preparing pitch articles, such as pitch moldings and pitch fibers. First, it has been shown that the mesophase content of heat-soaked petroleum-derived isotropic pitch can be significantly increased by mixing the isotropic pitch with an amount of synthetic mesophase pitch prior to the heat treatment. It has also been found that improved pitch moldings can be produced from a mixture of powdered synthetic mesophase pitch, serving as filler, and powdered partially anisotropic pitch, serving as a binder, when the synthetic mesophase pitch is sufficiently stabilized before it is mixed with the binder. The partially anisotropic pitch may be prepared by heat-soaking either petroleum-derived isotropic pitch or a mixture of petroleum-derived isotropic pitch and synthetic mesophase pitch. Stabilizing the synthetic mesophase pitch before mixing with the binder significantly reduces the amount of volatile components and forms stabilized molecular structures within the synthetic mesophase pitch, such that, upon carbonization after mixing with the partially anisotropic pitch binder, minimal bloating occurs as a result of volatilization of low molecular weight components and gasification of heteroatoms within the synthetic mesophase pitch. This produces pitch moldings with minimal, if any, voids or dimensional instability after carbonization.

Particularly, carbonized pitch moldings of this invention show good mechanical properties, electrical conductivity, and reasonable dimensional stability. However, due to the absence of reinforcing fibers within the binder matrix material, the carbonized pitch moldings show higher brittleness and lower mechanical properties than carbon fiber-reinforced carbon composites.

Carbon fibers of this invention exhibit highly ordered microstructures, high tensile strength and electrical conductivity, and similar Youngs's modulus to purely mesophase-based pitch fibers produced at the same carbonization conditions and degree of weight gain. Also, carbon fibers of this invention show circular cross-sections with smooth skin, few inside micropores, and radially-folded, transverse morphology after carbonization, as compared to synthetic mesophase pitch-based carbon fibers, which show wrinkled, circular cross-sections, with tough skin, many captured micropores, and transverse morphology of onion-skin structure. The reasons for higher mechanical and better electrical properties of pitch blend-based carbon fibers of this invention can be explained by this morphological superiority. Less defects, both on the surface and in the core, and radial folded morphological texture improve tensile properties and enhance electrical conductivity. Although not wishing to be bound to any particular theory, it is believed that the morphological superiority of carbon fibers according to this invention results from the fact that they are created from pitch blends that include a heat-soaked isotropic pitch (partially anisotropic pitch), which contains less lower molecular weight volatiles that would typically evaporate off during the oxidation and/or carbonization processes.

EXPERIMENTAL

In the following experiments, the petroleum-derived isotropic pitch employed was A240, obtained from Ashland Oil Company. The synthetic mesophase pitch employed was ARA 24, obtained from Mitsubishi Gas Chemical Company. Table 1 and the discussion thereof shows the increased mesophase formation realized when heat-soaking mixtures of petroleum-derived isotopic pitch and synthetic mesophase pitch. Table 2 and the discussion thereof shows the creation of pitch moldings according to this invention. Table 3 and the discussion thereof relates to pitch fibers according to this invention.

TABLE 1

Characterization of Pitches

| Samples | Heat-Soaking condition Temp (° C.) | Heat-Soaking condition Temp (hr) | $T_s$ (° C.) | MP (%) | Insolubility (w %) TI | BI | QI |
|---|---|---|---|---|---|---|---|
| A240 | — | — | 118 | 0.03 | 9.7 | 11.9 | 3.8 |
| ARA24 | — | — | 285 | 100 | 88.3 | 86.3 | 58.2 |
| Heat-soaked A240 | 400 | 5 | 138 | 2.7 | 31.5 | 33.9 | 8.8 |
| Heat-soaked A240 | 400 | 10 | 168 | 6.5 | 45.2 | 51.8 | 27 |
| Heat-soaked A240 | 400 | 20 | 297 | 74.5 | 73.6 | 77.4 | 68 |
| Heat-soaked A240 | 400 | 25 | 334 | 81.5 | 84.1 | 85 | 84.2 |
| Heat-soaked A240 | 420 | 5 | 199 | 18.0 | 51.4 | 55.2 | 43.4 |
| Heat-soaked A240 | 420 | 10 | 359 | 74.3 | 78.5 | 81.1 | 74.2 |
| Heat-soaked A240 | 440 | 2.5 | 201 | 8.3 | 63.4 | 66.2 | 50.2 |
| Heat-soaked A240 | 440 | 5 | 363 | 69.9 | 84.1 | 84.4 | 82.2 |
| A240/ARA24 (90/10) | 400 | 0 | N/A | N/A | 17.6 | 18.7 | 6.6 |
| A240/ARA24 (75/25) | 400 | 0 | N/A | N/A | 30.7 | 33 | 12.2 |
| A240/ARA24 (50/50) | 400 | 0 | N/A | N/A | 44.5 | 46.5 | 32.8 |
| A240/ARA24 (90/10) | 400 | 5 | 152 | 6.2 | 41.3 | 40.1 | 15.6 |
| A240/ARA24 (75/25) | 400 | 5 | 167 | 21.3 | 54.8 | 55.3 | 23.8 |
| A240/ARA24 (50/50) | 400 | 5 | 195 | 64.5 | 70.3 | 72.1 | 54.6 |
| A240/ARA24 (90/10) | 400 | 10 | 198 | 24.1 | 56.2 | 61.9 | 38.2 |
| A240/ARA24 (75/25) | 400 | 10 | 234 | 67.9 | 75.7 | 75 | 57 |
| A240/ARA24 (50/50) | 400 | 10 | 316 | 75.5 | 87.9 | 86.6 | 83.6 |

$T_s$: Softening point temperature.
MP: Mesophase content measured by optically anisotropic phase.

TI, BI, QI: Toluene, benzene, quinoline insolubilities measured by arbitrarily defined insolubility testing method.

Table 1 shows the characterization of petroleum-derived isotropic pitch (A240), synthetic mesophase pitch (ARA24), heat-soaked isotropic pitches, and the blends of isotropic pitch and synthetic mesophase pitch with or without heat-soaking. The petroleum-derived isotropic pitch were heat-soaked at various temperatures (400, 420, and 440° C.) for various durations of 2.5 to 25 hours. The isotropic pitch or mixture of isotropic and synthetic mesophase pitch were melt blended by stirring and heating to 400° C. at a heating rate 15° C./min without heat-soaking. The blends of isotropic pitch and synthetic mesophase pitch were then heat-soaked at 400° C. for 5 and 10 hours. The concentration of mixed synthetic mesophase pitch was varied from 10 to 50 weight percent.

The softening point temperature of sample pitches was measured by taking a mid-point in the range of softening of materials as temperature increased. The heat-soaked isotropic pitches showed significantly high softening temperatures when they were heat-soaked at higher temperatures. For example, the heat-soaked isotropic pitches at 440° C. showed much faster and larger increases in softening point temperature than heat-soaking at 400° C. This may be due to very severe thermal polymerization reaction at such a high temperatures, inducing the formation of infusible carbon structures into the heat-soaked isotropic phase. The softening point temperature of pitch blends heat-soaked at 400° C. showed a large effect on the increase of softening point temperature when the pitch blends were heat-soaked for longer heat-soaking times (10 hours or more).

The insolubility of sample pitches indicates the weight of insoluble content in solvents like benzene, toluene, and quinoline. The method for measuring insolubility is arbitrarily defined as dissolving small amount of sample pitch powder in solvents at room temperature, so the values may be different from those obtained by using a typical solvent boiling method. The insolubility of heat-soaked pitch blends of isotropic and synthetic mesophase pitches increased as the content of synthetic mesophase pitch and heat-soaking time increased.

The anisotropy of sample pitches was determined by measuring the area ratio of optically anisotropic domains to optically isotropic domains. A conventional technique using reflected, cross-polarized optical microscope was applied to measure area ratios. In Table 1, the optical anisotropy of isotropic pitch heat-soaked at 400° C. for 5 and 10 hours are 2.7% and 6.5%, respectively. The optical anisotropy of pitch blends heat-soaked at 400° C. for 10 hours ranged from 24.1% to 75.5%. If the optical anisotropy of heat-soaked pitch blends is subtracted by the sum of the anisotropy of heat-soaked isotropic pitch and the concentration of added synthetic mesophase pitch, which is considered as 100% optically anisotropic material, one can obtain the increased amount of optically anisotropic area for heat-soaked pitch blends. The pitch blend having 25% synthetic mesophase pitch heat-soaked at 400° C. for 10 hours shows the highest increase in optical anisotropy as much as 36.5%. For the cases of 10 hour heat-soaking, the increase of optical anisotropy ranged from 7.6% to 36.5%.

The obtained photomicrographs of heat-soaked pitch blends of petroleum-derived isotropic pitch and synthetic mesophase pitch are shown in FIG. 1. In photomicrographs taken under the magnification of 100, the optically isotropic region is shown as dark whereas optically anisotropic regions are shown as bright. One can observe the significant percent of optically anisotropic regions in three heat-soaked pitch blends: ARR24/A240 (50/50) at 400° C. for 5 hours, ARR24/A240 (25/75) at 400° C. for 10 hours, and ARR24/A240 (50/50) at 400° C. for 10 hours.

Figure 2:
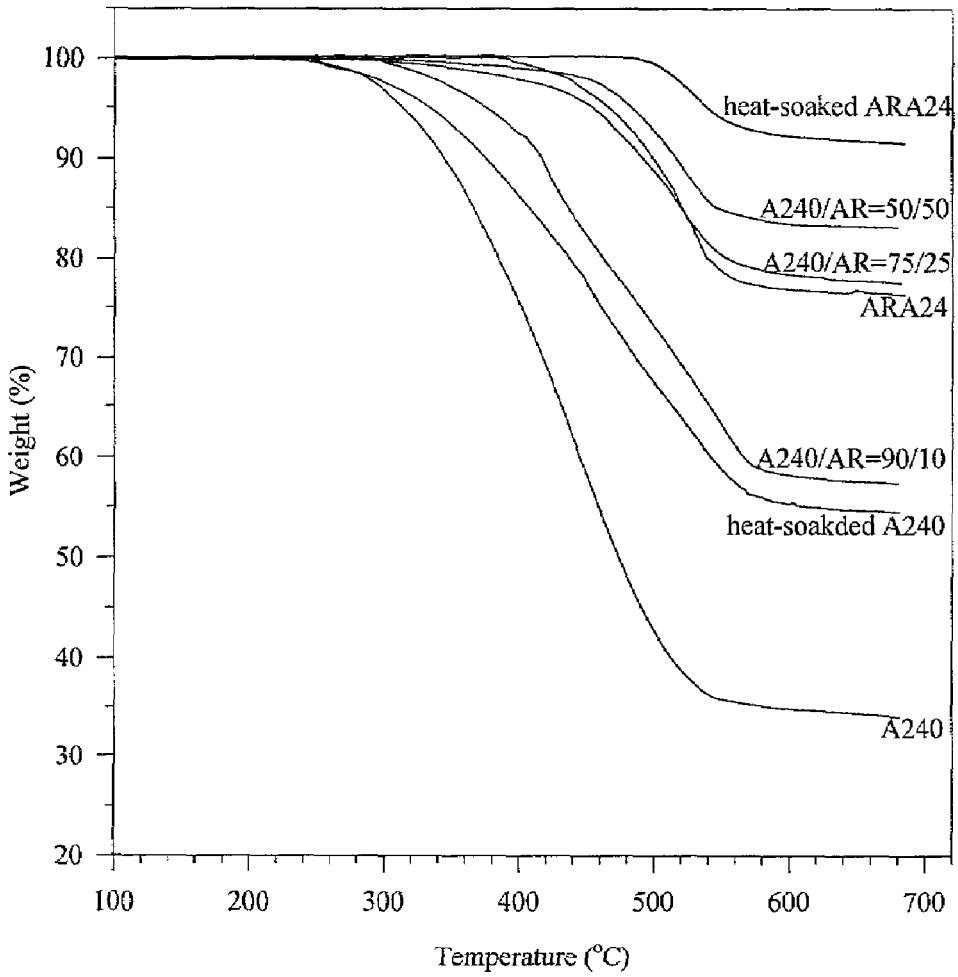
FIG. 2 show thermogravimetric analysis of heat-soaked petroleum-derived isotropic pitch, heat-soaked synthetic mesophase pitch, and heat-soaked pitch blends of such isotropic and mesophase pitches.

The thermal stability of petroleum-derived isotropic pitch (A240), synthetic mesophase pitch (ARA24), heat-soaked A240 and ARA24, and A240/ARA24 pitch blends heat-soaked at 400° C. for 10 hours was monitored by using Thermogravimetric Analysis (TGA) as shown in FIG. 2. Here, the heating rate was 20° C./min, in $N_2$ gas. In the plot, heat-soaked pitch blends with 25% and 50% concentration of mixed synthetic mesophase pitch show higher thermal stability than that of pure synthetic mesophase pitch.

Carbonized pitch moldings were prepared by powdering ARA 24 pitch and heat-soaked A240 pitch to less than 70 μm in cross-section, fully stabilizing the powdered ARA24 pitch, mixing the stabilized ARA24 pitch and heat-soaked A240 pitch, compression molding the mixtures, and carbonizing the moldings. The heat-soaking conditions for the heat-soaked A240 pitch, the mix ratio of the stabilized ARA24 and heat-soaked A240 pitch, and the mechanical, electrical, and microstructural properties of the final carbonized pitch moldings after carbonization at 1800° C. for 1 hour under inert environment are shown in Table 2.

TABLE 2

Carbonized Pitch Moldings After Carbonization

| Samples | Flexural Strength (MPa) | Electrical Resistivity (mΩ × m) | $d_{002}$ (Å) | $L_c$ (Å) | ($L_a$ Å) |
|---|---|---|---|---|---|
| Carbonized molding 1 | 24.8 | 43 | 3.472 | 72.647 | 63.271 |
| Carbonized molding 2 | 27.8 | 42.4 | 3.472 | 80.587 | 66.438 |
| Carbonized molding 3 | 27.7 | 37.5 | N/A | 75.860 | 61.804 |

Carbonized molding 1: mixture of fully oxidized ARA24 pitch/heat-soaked A240 pitch at 420° C. for 5 hours (70/30).

Carbonized molding 2: mixture of fully oxidized ARA24 pitch/heat-soaked A240 pitch at 420° C. for 7.5 hours (70/30).

Carbonized molding 3: mixture of fully oxidized ARA24 pitch/heat-soaked A240 pitch at 420° C. for 7.5 hours (60/40).

$\bar{d}_{002}$: Interlayer spacing.

$\bar{L}_a$ and $\bar{L}_c$: Crystallite size.

The flexural strength was measured by using the three-point bending test method. The values of measured flexural strength range from 24.8 to 27.8 MPa. Since the mixture of stabilized and binding pitch powders was compression-molded into pitch moldings without a plunger in the cavity the compactness of the pitch moldings was not high enough for high green density. If one applies high pressure into the cavity filled with pitch powder, one is expected to get higher flexural strength and lower electrical resistivity without the serious bloating problem after carbonization. The electrical resistivity of carbonized pitch moldings after carbonization at 1800° C. for one hour under inert environment was measured by a method similar to ASTM D6120-97, for measuring electrical resistance of high conductive material. The measured electrical resistivity ranges from 37.5 to 43.6 mΩ×m. The mixture having more concentration (40%) of binding material, fully oxidized ARA24 pitch/heat-soaked A240 pitch at 420° C. for 7.5 hours (60/40) showed better electrical conductivity. Therefore, if the dimensional stability of fusible binding material can be precisely controlled, more concentration of binding material in the mixture is desirable for better mechanical and electrical properties.

The microstructural properties such as interlayer spacing and crystallite sizes, in thickness ($\bar{L}_c$) and length ($\bar{L}_a$) were measured by using a Wide Angle X-ray Diffraction (WAXD) technique for solid specimens from carbonized pitch moldings. The interlayer spacing for the two different mixtures having 30% of binding material was almost the same, but crystallite sizes showed higher values for the mixture having a binding material that heat-soaked isotropic pitch for slightly longer time (7.5 hours). This is because the molecular weight, which contributes to larger crystallite size, increases as heat-soaking temperature and time increase. The microstructural properties are more influenced by final heat-treatment temperature than molding process conditions. So, in order to achieve high values of electrical conductivity, one needs to apply both high pressures for molding and ultra high heat-treatment temperatures for carbonization or graphitization.

As mentioned above, the heat-soaked petroleum-derived isotropic pitch or heat-soaked pitch blends of isotropic pitch with synthetic mesophase pitch may be used as a binder in the preparation of carbonized pitch moldings. Aside from carbon moldings, these materials may also be used in the manufacturing of pitch-based carbon fibers. The mesophase pitch-based carbon fiber has been used for high-end applications because it has better stiffness and electrical and thermal conductivity than polymer (PAN)-based carbon fibers. Unlike PAN-based carbon fibers, the carbonaceous pitch-based carbon fiber can be graphitizable above 2500° C. The synthetic mesophase pitch (ARA24) catalytically derived from a hydrocarbon (e.g., naphthalene) shows good spinnability and oxidation efficiency, but also shows significant volatilization during melt-spinning processes and high temperature carbonization. So, the significant amount of volatiles should be properly removed before or during spinning by heating or ventilation, respectively. In the production of pitch-based carbon fiber, if as-spun pitch fiber is fully stabilized by oxidation, it will not produce many microscopic pores in the fiber during high temperature carbonization.

In the present invention, the heat-soaked petroleum-derived isotropic pitch and heat-soaked pitch blends of isotropic pitch with synthetic mesophase pitch were also used to prepare carbon fibers exhibiting less porosity. Since heat-soaked pitch materials alone do not show sufficient spinnability to spin continuous pitch fiber, the present invention provides a blend of synthetic mesophase pitch, which has good spinnability, with heat-soaked pitch materials (isotropic pitch or pitch blend of isotropic pitch with synthetic mesophase pitch). Particularly, 50/50 blends of synthetic mesophase pitch and heat-soaked pitch materials were mixed at 350° C., under high shear and without heat-soaking. The prepared precursors were melt-spun into continuous monofilament at 317° C. by using a plunger-type spinning device and a spinning die of 0.508 mm in diameter. To remove infusible particles from the melt prior to spinning, a sintered-metal disc filter was employed, having a 5 μm open hole size and a diameter of 9.525 mm. 50/50 blends of synthetic mesophase pitch blended with pitch blends (isotropic pitch and synthetic mesophase pitch) heat-soaked at 400° C. for 5 and 10 hours showed relatively difficult spinnability since they had many infusible particles. The melt flow rate for continuous fiber spinning could not be sustained as the small metal filter became clogged with filtered solid particles. Applying a better filtering system, having larger surface area of filter, prior to melt spinning, is expected to make possible the continuous melt spinning of these types of pitch blends. 50/50 blends of synthetic mesophase pitch blended with isotropic pitches heat-soaked at 400° C. for extended heat-soaking times (20 and 25 hours) showed reasonable "spinnability"—that is, good enough to spin a continuous fiber—if solid particles were properly filtered out. However, improved filtering systems are desirable for better spin processing of these types of pitch precursors. Based on experimental observation, the pure synthetic mesophase pitch can be spun into pitch fiber with ease.

The as-spun pitch fibers from synthetic mesophase pitch and the 50/50 pitch blends of synthetic mesophase pitch and heat-soaked isotropic pitches at 400° C. for 20 and 25 hours were cut into short fibers (length approx. 5 cm) and then fully stabilized at the temperature range of 275~280° C., with a heating rate of 3.5° C./min. At the same stabilization condition, the 50/50 blends-based pitch fibers needed relatively longer oxidation time (about 5 hours) to obtain the target weight gain of 7%, while the synthetic mesophase pitch fibers needed less than 1 hour for the same amount of weight gain. Next, the stabilized pitch fibers were heated up to 1800° C., with heating rate of 10° C./min, and then heat-soaked at the final temperature for 15 minutes, under inert environment.

Table 3 shows the properties of carbon fibers derived from synthetic mesophase pitch (ARA24) and the 50/50 pitch blends of synthetic mesophase pitch with heat-soaked isotropic pitches (A240). The carbonization conditions were 1100° C. for 200 minutes and 1800° C. for 15 minutes. In Table 3, weight gain means the weight gain of stabilized pitch fibers by oxidation in air, and interlayer spacing indicates the interlayer spacing of (002) plane. As a reference, the interlayer spacing of synthetic mesophase pitch fiber before carbonization is measured as 3.616 (Å).

TABLE 3

Properties of carbon fibers (CF)

| Sample | Weight gain (%) | Tensile Strength (MPa) | Young's Modulus (GPa) | Elongation at Break (%) | Electrical Resistivity (μΩ.m) | Inter-layer spacing (Å) |
|---|---|---|---|---|---|---|
| ARA24 CF[1] | 7 | 310.82 | 86.86 | 0.63 | N/A | 3.472 |
| ARA24 CF[2] | 7 | 523.02 | 115.31 | 0.571 | 11.89 | 3.440 |
| ARA24 CF[2] | 8 | 660.32 | 166.36 | 0.528 | 12.99 | 3.461 |
| ARA24 CF[2] | 9 | 644.16 | 153.37 | 0.494 | 13.34 | 3.472 |
| Blend CF[3] | 7 | 859.39 | 165.84 | 0.664 | 9.76 | 3.461 |
| Blend CF[4] | 7 | 954.54 | 153.92 | 0.842 | 10.16 | 3.461 |

[1]ARA24 carbon fiber carbonized at 1100° C. for 200 min.
[2]ARA24 carbon fiber carbonized at 1800° C. for 15 min, spun by using 5 μm sintered metal filter.
[3]Carbon fiber derived from the 50/50 pitch blend of ARA24 pitch and A240 pitch heat-soaked at 400° C. for 20 hours, the pitch blend is mixed at 350° C. without heat-soaking and spun by using 5 μm sintered metal filter.
[4]Carbon fiber derived from the 50/50 pitch blend of ARA24 pitch and A240 pitch heat-soaked at 400° C. for 25 hours, the pitch blend is mixed at 350° C. without heat-soaking and spun by using 5 μm sintered metal filter.

1) ARA24 carbon fiber carbonized at 1100° C. for 200 min.
2) ARA24 carbon fiber carbonized at 1800° C. for 15 min, spun by using 5 μm sintered metal filter.
3) Carbon fiber derived from the 50/50 pitch blend of ARA24 pitch and A240 pitch heat-soaked at 400° C. for 20 hours, the pitch blend is mixed at 350° C. without heat-soaking and spun by using 5 μm sintered metal filter.
4) Carbon fiber derived from the 50/50 pitch blend of ARA24 pitch and A240 pitch heat-soaked at 400° C. for 25 hours, the pitch blend is mixed at 350° C. without heat-soaking and spun by using 5 μm sintered metal filter.

The ARA24 pitch fiber carbonized at 1100° C. for 200 min, showed lower mechanical properties than the same pitch fiber carbonized at 1800° C. for much shorter time (15 min). The ARA24 pitch carbon fiber suffered from low mechanical properties like tensile strength and Young's modulus when it was stabilized to a low degree of oxidation (7% weight gain) prior to carbonization at 1800° C. This may be because the low degree of oxidation was not enough to achieve full stabilization of molecular structures during carbonization, causing more micropores. In general, the carbon fibers derived from the 50/50 pitch blends of synthetic mesophase pitch (ARA24) and isotropic pitch (A240) showed higher mechanical properties and electrical conductivity than those of synthetic mesophase pitch-based carbon fibers with the same carbonization conditions. Among pitch blend-based carbon fibers, the slight difference in the heat-soaking degree of isotropic pitch did not make a considerable difference in mechanical and electrical properties.

Figure 3:
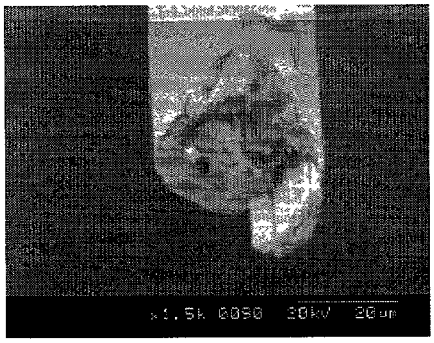
FIG. 3 shows scanning electron microscope (SEM) photomicrographs of carbon fibers according to the prior art ((a) and (b)) for comparison against carbon fibers according to this invention ((c) and (d)).
Figure 3:
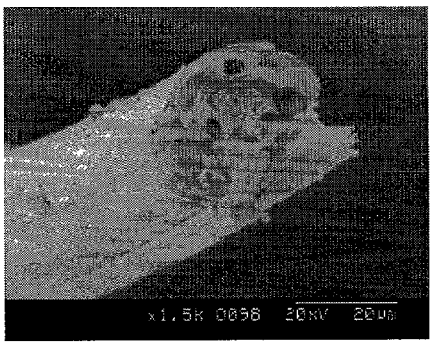
Figure 3:
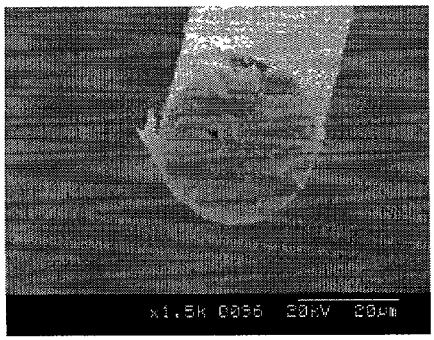
Figure 3:
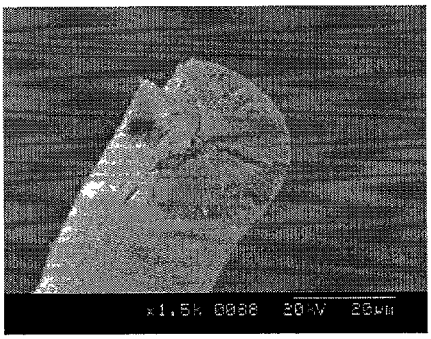

It is believed that carbon fibers derived from pitch blends show higher mechanical properties mainly because they have less defects and more desirable morphological characteristics. FIG. 3 shows scanning electron microscope (SEM) photomicrographs of carbon fibers carbonized at 1800° C. for 15 or 60 minutes. The changes in pitch precursors, spinning, and carbonization conditions affect the amount of defects and the morphology of fractured cross-sections of the final carbon fibers. As shown in photomicrographs (a) and (b), synthetic mesophase pitch-based carbon fibers show significant size and number of pores and the transverse morphology of onion-skin structure near surface and random structure in core. The cross-sectional shape of this carbon fiber is close to circular shape and the carbon fiber has tough and irregular skin surface. The several captured pores shown in the core region may be caused by the volatilization of low molecular weight volatiles.

On the other hand, the carbon fibers from the 50/50 pitch blend of synthetic mesophase pitch and heat-soaked isotropic pitch show radial-folded transverse texture as shown in photomicrographs (c) and (d). The cross-sectional shape of this type of carbon fiber is more circular, with a smooth surface, than that of synthetic mesophase pitch-based carbon fibers. The less defects and smooth surface in this type of carbon fiber may be achieved by the removal of volatiles from precursors like synthetic mesophase pitch and heat-soaked isotropic pitch during both the heat-soaking of the isotropic pitch and the blending of the two different pitches.

It is appreciated that the tensile strength of fibers depends strongly on the concentration of flaws or local defects within the fibers. In the present invention, since carbon fibers derived from pitch blends exhibit fewer imperfections, like micro-pores and surface defects, and, rather, exhibit desirable radial-folded texture in cross-section, one can expect better mechanical properties than those of carbon fibers derived from synthetic mesophase pitch. In the present invention, the different transverse textures of carbon fibers prepared from various pitch precursors seem to be caused both by using different precursors and by the spinning effect mentioned above.

The lower resistivity of carbon fiber derived from the pitch blend of synthetic mesophase pitch and heat-soaked isotropic pitch may be explained in terms of the difference in morphological characteristics. The folded-radial transverse morphology, without any skin-core structure, as shown above for pitch blend fibers, is believed to be a better morphological characteristic for good electrical conduction than the random transverse morphology typically exhibited by carbon fibers derived from synthetic mesophase pitch.

In light of the foregoing, it should thus be evident that the process of the present invention, providing carbonized pitch articles from mixtures of a synthetic mesophase pitch and heat-soaked isotropic pitch, substantially improves the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. A process for preparing pitch with increased optically anisotropic content, comprising the steps of:

mixing from about 10% to about 70% of synthetic mesophase pitch and from about 90% to about 30% by weight of petroleum-derived isotropic pitch to prepare a pitch mixture; and heat-soaking the resultant mixture at a temperature of from about 400° C. to about 450° C. for about 5 to about 25 hours to convert isotropic pitch to optically anisotropic mesophase pitch.

2. The process of claim 1, wherein said step of heat-soaking includes heating the pitch mixture in an inert atmosphere.

3. A process for preparing pitch with increased optically anisotropic content, comprising the steps of:

mixing a mixture consisting essentially of from about 10% to about 70% by weight of synthetic mesophase pitch and from about 90% to about 30% by weight of petroleum-derived isotropic pitch to prepare a pitch mixture; and heat-soaking the resultant pitch mixture at a temperature of from about 350° C. to about 450° C. for about 5 to about 25 to convert isotropic pitch to optically anisotropic mesophase pitch.

4. The process of claim 3, wherein said step of heat-soaking includes heating the pitch mixture, in an inert atmosphere.

* * * * *